US009091969B2

(12) United States Patent
Yoshida et al.

(10) Patent No.: US 9,091,969 B2
(45) Date of Patent: Jul. 28, 2015

(54) ELECTROPHOTOGRAPHIC IMAGE FORMING APPARATUS

(71) Applicants: Ryuji Yoshida, Kanagawa (JP); Hideki Zemba, Kanagawa (JP); Yusuke Mitani, Kanagawa (JP); Shotaro Hoshi, Kanagawa (JP); Masahiko Shakuto, Kanagawa (JP); Hiroaki Maeda, Kanagawa (JP)

(72) Inventors: Ryuji Yoshida, Kanagawa (JP); Hideki Zemba, Kanagawa (JP); Yusuke Mitani, Kanagawa (JP); Shotaro Hoshi, Kanagawa (JP); Masahiko Shakuto, Kanagawa (JP); Hiroaki Maeda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/173,044

(22) Filed: Feb. 5, 2014

(65) Prior Publication Data

US 2014/0255050 A1 Sep. 11, 2014

(30) Foreign Application Priority Data

Mar. 5, 2013 (JP) ..... 2013-042633

(51) Int. Cl.
*G03G 15/16* (2006.01)
*G03G 15/02* (2006.01)
*G03G 15/06* (2006.01)

(52) U.S. Cl.
CPC ..... *G03G 15/1675* (2013.01); *G03G 15/0266* (2013.01); *G03G 15/065* (2013.01)

(58) Field of Classification Search
CPC ..... G03G 15/0266; G03G 15/1675
USPC ..... 399/46, 50, 55, 66
See application file for complete search history.

(56) References Cited

U.S. PATENT DOCUMENTS

| | | | | |
|---|---|---|---|---|
| 6,128,449 | A | 10/2000 | Zenba et al. | |
| 6,160,969 | A | 12/2000 | Ishigaki et al. | |
| 7,295,796 | B1 | 11/2007 | Murakami et al. | |
| 2002/0127025 | A1 * | 9/2002 | Sasai | 399/44 |
| 2004/0042808 | A1 * | 3/2004 | Suzumi et al. | 399/66 |

(Continued)

FOREIGN PATENT DOCUMENTS

| | | |
|---|---|---|
| JP | 2000-293083 | 10/2000 |
| JP | 2003-140405 | 5/2003 |

(Continued)

OTHER PUBLICATIONS

Machine Translation of JP 2000-293083 A, obtained on Nov. 25, 2014.*

The Extended European Search Report issued Aug. 7, 2014, in Application No. / Patent No. 14154775.2-1560.

*Primary Examiner* — Gregory H Curran

(74) *Attorney, Agent, or Firm* — Oblon, McClelland, Maier & Neustadt, L.L.P.

(57) ABSTRACT

An image forming apparatus includes a charging bias output device, a developing bias output device, a transfer bias output device, and a controller. The controller controls the transfer bias output device to supply a transfer bias from a time at which a first position of a photosensitive member arrives at a transfer position after the charging bias output device starts supplying a charging bias. An initial value of the transfer bias is controlled to be smaller than a normal set value for a predetermined time period which is a time after the transfer bias starts to be supplied and within a time corresponding to a rise time during which a surface potential of the photosensitive member reaches a predetermined potential after the charging bias starts to be output. The first position of the photosensitive member is a position at which the charging device starts charging the photosensitive member.

25 Claims, 9 Drawing Sheets

(56) References Cited

U.S. PATENT DOCUMENTS

| | | | | |
|---|---|---|---|---|
| 2005/0180767 | A1* | 8/2005 | Ishii et al. | 399/66 |
| 2006/0251438 | A1 | 11/2006 | Uchitani et al. | |
| 2008/0069588 | A1 | 3/2008 | Inaba et al. | |
| 2009/0196638 | A1 | 8/2009 | Sukesako et al. | |
| 2009/0220267 | A1 | 9/2009 | Takahashi | |
| 2010/0209127 | A1 | 8/2010 | Hokkyoh et al. | |

FOREIGN PATENT DOCUMENTS

| | | |
|---|---|---|
| JP | 2006-145605 | 6/2006 |
| JP | 2008-146013 | 6/2008 |
| JP | 2010-026083 | 2/2010 |

* cited by examiner

RELATED-ART PRIMARY TRANSFER BIAS RISE

ELECTROPHOTOGRAPHIC IMAGE FORMING APPARATUS

CROSS-REFERENCE TO RELATED APPLICATIONS

This patent application is based on and claims priority pursuant to 35 U.S.C. §119 to Japanese Patent Application No. 2013-042633, filed on Mar. 5, 2013, in the Japan Patent Office, the entire disclosure of which is hereby incorporated by reference herein.

BACKGROUND

1. Technical Field

Exemplary aspects of the present disclosure generally relate to an electrophotographic image forming apparatus, more particularly to a transfer bias control employed in an image forming apparatus.

2. Description of the Related Art

Image forming apparatuses such as a copier, a printer, a facsimile machine, and a digital multi-functional system including a combination thereof generally employ an electrophotographic method.

The image forming apparatuses of this kind form an electrostatic latent image by charging uniformly a surface of a photosensitive member and illuminating the charged surface with laser light associated with an image data. The thus-obtained electrostatic latent image is developed with toner to form a toner image. The toner image on the surface of the photosensitive member is transferred directly onto a recording medium or is transferred onto an intermediate transfer member before transferring secondarily the toner image onto the recording medium. The toner image transferred onto the recording medium is fixed by a fixing device. After fixing, the recording medium is discharged outside the apparatus.

In such an image forming apparatus, for example, in a copying machine, there is a time lag between a time at which users press a copy-start button and a time at which a first sheet of recording medium on which an image is formed is discharged. This time lag is also known as a first copy time (FCOT) during which the users have to wait, and shortening this first copy time leads to improving operating efficiency of the users.

In the image forming apparatus, other than the copying machine, the time lag also occurs when carrying out a new print job. More specifically, a time period until the first image is output after printing is instructed corresponds to the first copy time mentioned above. In this case, this time period is referred to as a first image output time (FCOT).

The first image output time (FCOT) can be shortened by accelerating a process linear velocity. However, in order to reduce power consumption, in general, it is necessary to reduce the process linear velocity, thereby complicating efforts to shorten the first image output time as is usually desired. In other words, efforts to shorten the first image output time contradict efforts to reduce the power consumption.

Reducing a preparation time for printing in an image forming unit can shorten the first image output time (FCOT), which does not affect energy saving characteristics. Therefore, shortening the preparation time for printing in the image forming unit can lead to reduction of the waiting time for the users, and hence there is demand for a short preparation time for printing.

In view of the above, various approaches have been proposed in an attempt to adjust the time at which a transfer bias (a primary transfer bias in the case of an intermediate transfer method using the intermediate transfer member) is applied to a transfer member such as a transfer roller to transfer the toner image from the photosensitive member to a recording medium or to the intermediate transfer member.

In order to facilitate an understanding of the novel features of the present disclosure, as a comparison, a description is provided of a charging position, a writing position, a developing position, and a transfer position in a related-art image forming apparatus using the electrophotographic method with reference to FIG. 10. In FIG. 10, the related-art image forming apparatus includes a photosensitive drum 102 that rotates in the direction of arrow A, a charging roller 200 serving as a charger, a developing roller 300 serving as a developer bearing member of a developing device, and a transfer roller 400 serving as a transfer device.

A place on a surface 102*a* of the photosensitive drum 102 charged by the charging roller 200 is referred to as a charging position B. A place on the surface 102*a* at which an electrostatic latent image is formed due to exposure with laser light L from a writing unit is referred to as a writing position C. A place on the surface 102*a* at which the electrostatic latent image is developed by the developing roller 300, hence forming a toner image, is referred to as a developing position D. A place on the surface 102*a* at which the transfer roller 400 transfers the toner image onto a recording medium or an intermediate transfer belt is referred to as a transfer position E.

A time at which a charging bias (voltage) starts to be supplied to the charging roller 200 is referred to as a charging bias output timing. A time at which a transfer bias (voltage) starts to be applied to the transfer roller 400 is referred to as a transfer bias output timing.

More specifically, the transfer bias output timing is a time at which the transfer bias is output when the charging position B of the surface 102*a* of the photosensitive drum 102 arrives at the transfer position E after the charging bias output timing.

The surface 102*a* of the photosensitive drum 102 is normally charged to a negative potential. At the transfer position, the polarity of the surface 102*a* shifts to a positive polarity due to the transfer bias. If, after the first charging of the surface 102*a*, the surface 102*a* of the photosensitive drum 102 includes a charged portion to which the transfer bias is not applied and a portion which has not been charged and hence the transfer bias is applied thereto, a trace of the transfer bias remains easily at the electrical potential on the surface 102*a* of the photosensitive drum 102 when charging for the second time. As a result, when forming a halftone image or the like, an electrical potential difference generated on the first sheet of image formation causes a difference in the image density of a developed image, which appears as a horizontal streak perpendicular to a direction of conveyance of the recording medium in an output image.

To address this difficulty, in one approach, after a position (hereinafter referred to as charging start position) on the surface 102*a* of the photosensitive drum 102 from which charging of the surface 102*a* is started for the first time passes the transfer position E, the transfer bias starts to be supplied. The place to which the transfer bias starts to be applied is charged for the second time at the charging position B and arrives at the writing position C. Subsequently, writing is started. With this configuration, the above difficulty is prevented.

Although advantageous, there is a relatively long time lag between the start of charging and the start of image formation, resulting in a relatively long first image output time (FCOT).

The image forming apparatus may include a charge removing device upstream from the charging position B in the direction of rotation of the photosensitive drum 102 so as to remove residual charge on the surface 102*a* of the photosensitive drum 102 prior to the subsequent charging, that is, the second charging and thereafter. With this configuration, the trace of the transfer bias does not remain, and writing can be started when the leading end of the charged portion of the surface 102*a* arrives at the writing position C. However, providing the charge removing device to remove the charge on the surface 102*a* over the entire axial direction of the photosensitive drum 102 is expensive.

In view of the above, the transfer bias is supplied when the charging start position of the surface 102*a* arrives at the transfer position as described above.

In this configuration, when the charging start position of the surface 102*a* arrives at the transfer position E, the transfer bias is applied thereto and the surface potential of the surface 102*a* shifts to the positive side. Thereafter, the charging bias is applied continuously, and hence the electrical potential difference after the second charging is reduced.

Accordingly, even when writing is started at a time at which the first charging start position of the surface 102*a* arrives at the writing position, the horizontal streak due to the difference in image density hardly appears. Furthermore, since image formation can be started immediately after the start of charging, the first image output time (FCOT) can be shortened.

Supplying the transfer bias when the charging start position of the surface 102*a* arrives at the transfer position is advantageous in that the difference in the image density can be reduced. However, a thin horizontal streak may still appear. This is because when the timing is met perfectly, overshoot is generated at the rise timing of the output of the transfer bias and the trace of the transfer bias remains strongly at a local area equivalent of several tens of milliseconds (ms), much stronger than other areas, which appears as a thin black streak in a resulting output image.

The degree of the overshoot depends on the rise time of the surface potential of the photosensitive drum 102 facing the transfer roller 400. It is generally the case that the rise time takes approximately one hundred milliseconds when the charging bias is applied by a known charging roller, for example, the charging roller 200, regardless of a contact-type or contact-free charger.

When applying the transfer bias to the surface 102*a* of the photosensitive drum 102 having a surface potential with the aforementioned rise time, a response from a power source of the transfer bias is delayed regardless of constant current control or constant voltage control. Consequently, overshoot of ten to twenty percent greater than a predetermined electrical current value or a voltage value occurs in the transfer bias for several tens of milliseconds upon rising and gets stabilized thereafter.

The surface potential of the portion of the photosensitive drum 102 corresponding to the area in which the overshoot has occurred shifts to the positive side relative to the area, the surface potential of which is stabilized. As a result, the trace of the transfer bias remains even after the subsequent charging or the second charging. When starting the image formation early so that these areas arrive at the image forming region fast in order to shorten the first image output time, the trace of overshoot in the transfer bias appears as a thin black streak in a halftone image.

In view of the above, JP-2010-26083-A proposes a primary transfer bias subjected to constant current control when transferring a toner image from the photosensitive member onto the intermediate transfer belt in the intermediate transfer method.

In this approach, based on an observed surface potential of the photosensitive member, a target electrical current value for the transfer bias is determined. For example, for the photosensitive member having a relatively high surface potential, a relatively high primary transfer bias is applied. Accordingly, when the surface potential of the photosensitive member is set such that the difference between the potential at the first charging and the potential at the second charging is relatively large, the potential difference is smoothed by a higher transfer bias. Thus, the density difference is difficult to occur.

However, the image forming apparatus proposed in JP-2010-26083-A does not specify the timing at which the primary transfer bias is supplied. In a case in which the image formation is initiated so as to shorten the first image output time (FCOT), a horizontal black streak as mentioned above is generated. Furthermore, JP-2010-26083-A is silent with respect to generation of overshoot.

In another approach, according to JP-4072532-B1 (JP-2006-145605-A), a band of toner is adhered to the photosensitive member in advance by calculating backwards based on the output timing of the transfer bias in the direct transfer method so as to prevent the toner from getting transferred to a recording medium. When the transfer bias is supplied, the band of toner lies in the transfer nip, thereby preventing the trace of transfer bias from remaining due to overshoot.

In JP-4072532-B1 (JP-2006-145605-A), an area with the intervening toner band and an area without the intervening toner band are created so that irregular image density occurs when forming an image. Although this configuration prevents the trace of transfer bias due to overshoot, the history of output of the primary transfer bias, that is, whether the primary transfer bias has been output, appears as a difference in the image density.

In view of the above, there is thus an unsolved need for an image forming apparatus capable of producing an image without irregular image density and an undesirable horizontal streak while shortening the first image output time (FCOT).

SUMMARY

In view of the foregoing, in an aspect of this disclosure, there is provided an image forming apparatus including a photosensitive member, a charging device, an exposure device, a developing device, a transfer device, a charging bias output device, a developing bias output device, a transfer bias output device, and a controller. The photosensitive member bears an electrostatic latent image on a surface thereof. The charging device charges the surface of the photosensitive member. The exposure device illuminates a charged surface of the photosensitive member to form an electrostatic latent image on the surface of the photosensitive member. The developing device develops the electrostatic latent image using toner to form a toner image. The transfer device transfers the toner image from the photosensitive member to a transfer medium at a transfer position. The charging bias output device supplies a charging bias to the charging device. The developing bias output device supplies a developing bias to the developing device. The transfer bias output device supplies a transfer bias to the transfer device. The controller is operatively connected to the charging bias output device, the developing bias output device, and the transfer bias output device to control the charging bias output device, the developing bias output device, and the transfer bias output device. The controller controls the transfer bias output device to supply the transfer bias from a time at which a first position of the photosensitive member arrives at the transfer position after the charging bias output device starts supplying the charging bias. An initial value of the transfer bias is controlled to be smaller than a normal set value for a predetermined time period (Tc) which is a time after the transfer bias starts to be supplied and within a time corresponding to a rise time (Ta) during which a surface potential of the photosensitive member reaches a predetermined potential after the charging bias starts to be output. The first position of the photosensitive member is a position at which the charging device start charging the photosensitive member.

According to another aspect, there is provided an image forming apparatus including a photosensitive member, a charging device, an exposure device, a developing device, a transfer device, a charging bias output device, a developing bias output device, a transfer bias output device, and a controller. The photosensitive member bears an electrostatic latent image on a surface thereof. The charging device charges the surface of the photosensitive member. The exposure device illuminates a charged surface of the photosensitive member to form an electrostatic latent image on the surface of the photosensitive member. The developing device develops the electrostatic latent image using toner to form a toner image. The transfer device transfers the toner image from the photosensitive member to a transfer medium at a transfer position. The charging bias output device supplies a charging bias to the charging device. The developing bias output device supplies a developing bias to the developing device. The transfer bias output device supplies a transfer bias to the transfer device. The controller is operatively connected to the charging bias output device, the developing bias output device, and the transfer bias output device to control the charging bias output device, the developing bias output device, and the transfer bias output device. The controller controls the transfer bias output device to supply a first transfer bias by which the toner image is transferred from the photosensitive member to the transfer medium, from a time at which a first position of the photosensitive member arrives at the transfer position, after the charging bias output device starts supplying a normal charging bias. An initial value of the transfer bias is controlled to be smaller than a normal set value for a predetermined time period (Tc) which is a time after the transfer bias starts to be supplied and within a time corresponding to a rise time (Ta) during which a surface potential of the photosensitive member reaches a predetermined potential after the charging bias starts to be output. The first position of the photosensitive member is a position at which the charging device start charging the photosensitive member.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
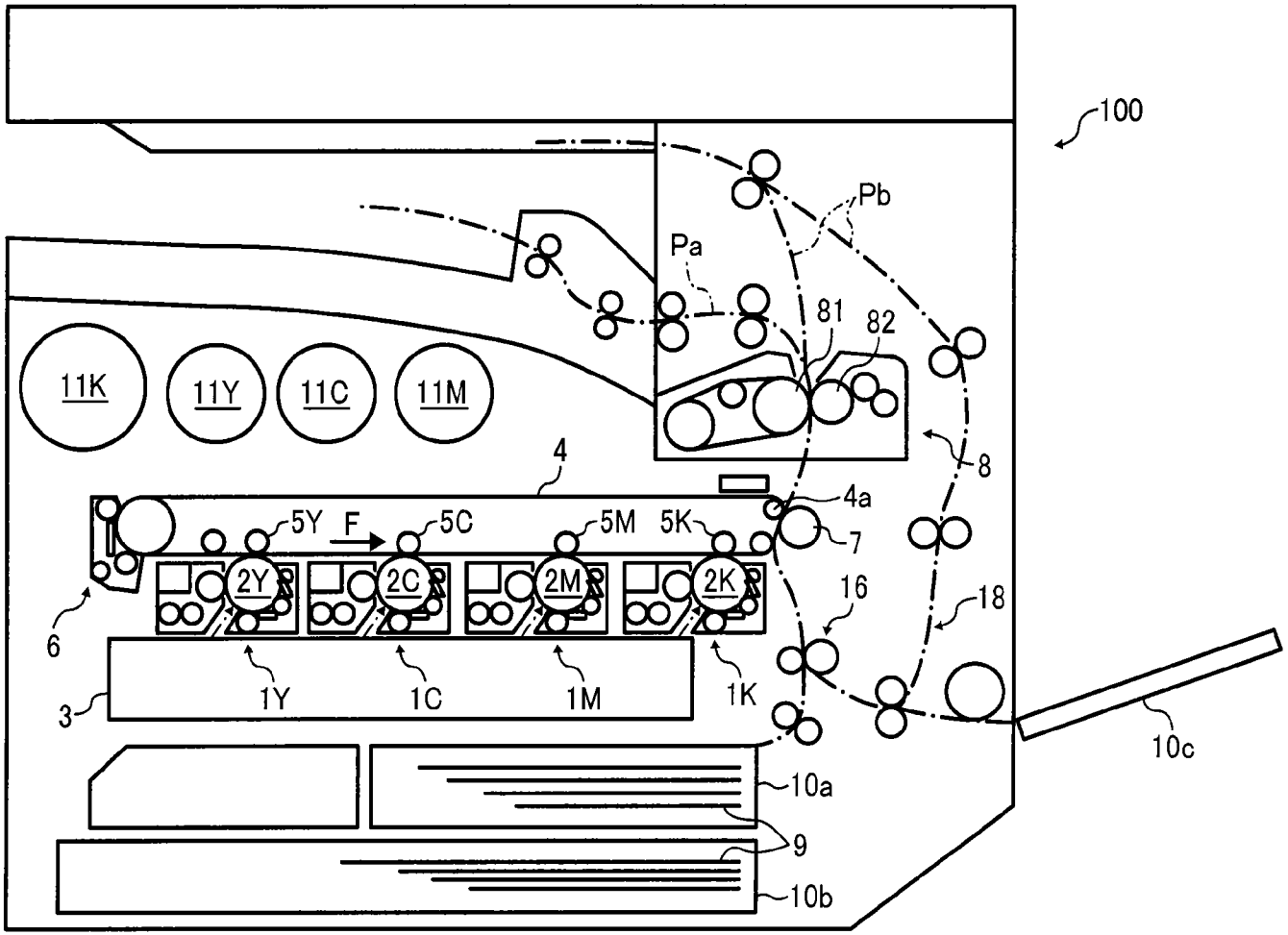
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

With reference to FIG. 1, a description is provided of an image forming apparatus according to an illustrative embodiment of the present disclosure.

FIG. 1 is a schematic diagram illustrating an electrophotographic image forming apparatus 100 using a tandem-type indirect transfer method according to an illustrative embodiment of the present disclosure. The image forming apparatus 100 includes four image forming units 1Y, 1C, 1M, and 1K, one for each of the colors yellow (Y), cyan (C), magenta (M), and black (K), respectively. It is to be noted that the suffixes Y, C, M, and K denote colors yellow, cyan, magenta, and black, respectively. These suffixes are omitted, unless the discrimination of the colors is necessary. The order of arrangement of the image forming units is not limited to the configuration described above. The image forming units may be arranged in the order of yellow, magenta, cyan, and black, for example.

The image forming units 1Y, 1C, 1M, and 1K includes photosensitive drums 2Y, 2C, 2M, and 2K, respectively. Each of the photosensitive members 2Y, 2C, 2M, and 2K is surrounded with a charging roller 15 serving as a charger, a developing roller 32 serving as a developing device (shown in FIG. 2), and a cleaning device. The image forming units 1Y, 1C, 1M, and 1K are disposed with a predetermined interval between each other in a direction of movement of an intermediate transfer belt 4 serving as an intermediate transfer member such that rotary shafts of the photosensitive drums 2Y, 2C, 2M, and 2K are parallel with each other.

An optical writing unit, or simply a writing unit 3 for writing a latent image on the photosensitive drums 1Y, 1C, 1M, and 1K is disposed above the image forming units 1Y, 1M, 1C, and 1K. The optical writing unit 3 includes a light source, a polygon mirror, an f-θ lens, a reflective mirror, and so forth, and illuminates the surface of the photosensitive drums 2Y, 2C, 2M, and 2K with four, modulated light beams based on image data of each color.

The intermediate transfer belt 4 serving as an intermediate transfer member and primary transfer rollers 5Y, 5C, 5M, and 5K serving as transfer devices are disposed above the image forming units 1Y, 1C, 1M, and 1K. The intermediate transfer belt 4 rotates in a direction of arrow F such that toner images formed in each of the image forming units 1Y, 1C, 1M, and 1K are transferred onto the intermediate transfer belt 4 so that they are superimposed one atop the other, thereby forming a composite toner image on the intermediate transfer belt 4.

The primary transfer rollers 5Y, 5C, 5M, and 5K are disposed opposite the photosensitive drums 2Y, 2C, 2M, and 2K, respectively, with the intermediate transfer belt 4 interposed therebetween to form primary transfer nips, in each of which the toner image is primarily transferred from the photosensitive drums 2Y, 2C, 2M, and 2K to the intermediate transfer belt 4.

The intermediate transfer belt 4 is entrained about a plurality of rollers and formed into an endless loop. A belt cleaning device 6 equipped with a brush roller and a cleaning blade is disposed at the left side of the intermediate transfer belt 4 in FIG. 1 such that the brush roller and the cleaning blade of the belt cleaning device 6 contact the outer circumferential surface of the intermediate transfer belt 4. The belt cleaning device 6 removes residual toner remaining on the intermediate transfer belt 4 after transfer of the toner image.

A secondary transfer roller 7 is disposed at the right side of the intermediate transfer belt 4 in FIG. 1. The secondary transfer roller 7, the intermediate transfer belt 4, and a drive roller 4*a* serving as a secondary-transfer opposing roller for driving the intermediate transfer belt 4 constitute a secondary transfer unit to transfer the toner image from the intermediate transfer belt 4 onto a recording medium (e.g., paper or the like).

A fixing device 8 is disposed above the secondary transfer roller 7. According to the present illustrative embodiment, the fixing device 8 employs a fixing method using a fixing belt.

Sheet cassettes 10*a* and 10*b*, each storing a stack of recording media, are disposed substantially at the bottom portion of the image forming apparatus 100. At the lateral side of the image forming apparatus 100, a side tray 10*c* is disposed to feed a recording medium manually. The image forming apparatus 100 includes a conveyor unit 18 for double-sided printing in which an image is formed on both sides of the recording medium.

The image forming apparatus 100 includes a waste toner bottle, a power source unit, toner supply bottles 11Y, 11C, 11M, and 11K, each of which stores toner of respective color, and so forth.

Figure 2:
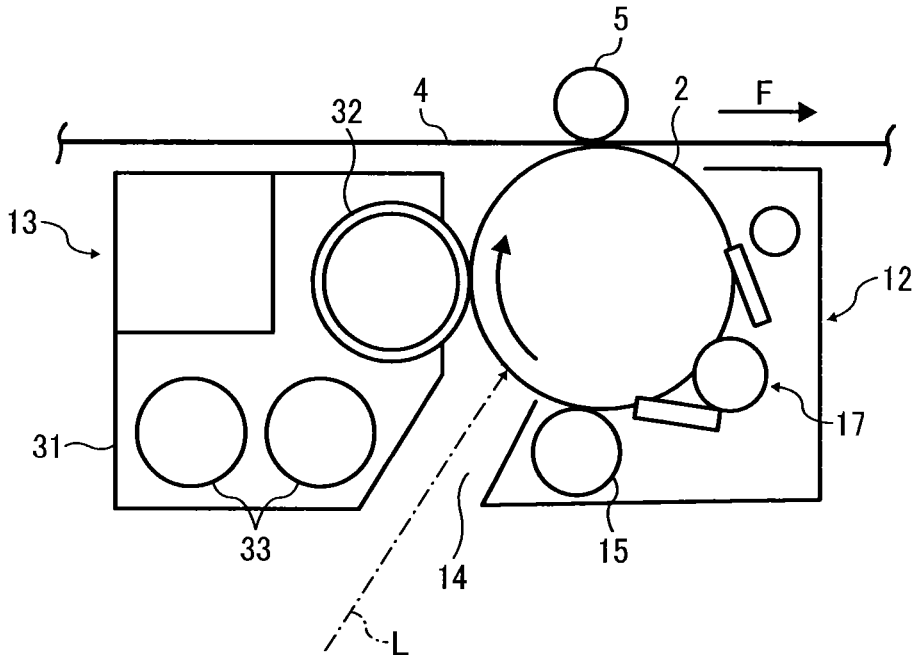
FIG. 2 is a schematic diagram illustrating an example of image forming units employed in the image forming apparatus of FIG. 1.

The image forming units 1Y, 1C, 1M, and 1K all have the same configuration as all the others, differing only in the color of toner employed. Thus, in FIG. 2, one of the image forming units 1Y, 1C, 1M, and 1K is shown as a representative example and suffixes Y, C, M, and K, indicating colors are omitted. As illustrated in FIG. 2, a photosensitive drum unit 12 and a developing unit 13 constitute the image forming unit 1 (i.e., the image forming units 1Y, 1C, 1M, and 1K). A space 14 is provided between the photosensitive drum unit 12 and the developing unit 13 to allow the laser light L from the writing unit 3 to strike the photosensitive drum 2.

As illustrated in FIG. 2, the photosensitive drum unit 12 includes the photosensitive drum 2, the charging roller 15 serving as a charger, the cleaning device 17 serving as a cleaner, and so forth. The developing unit 13 includes a container 31 to store a developing agent inside thereof. In the container 31, a developing roller 32, screws 33, a toner density detector, and so forth are disposed. The screws 33 mix and transport the developing agent.

The container 31 of the developing unit 13 of each of the image forming units 1Y, 1C, 1M, and 1K stores a two-component developing agent consisting of toner particles for the respective color and magnetic carriers. The developing roller 32 serving as a developing device includes a rotatable sleeve and a magnet fixed inside the rotatable sleeve. The sleeve carries the developing agent on the outer circumferential surface thereof while rotating, thereby having the developing agent to contact the outer circumferential surface of the photosensitive drum 2. In accordance with the output of the toner density detector, toner is supplied from the toner supply bottles 11Y, 11C, 11M, and 11K.

As illustrated in FIG. 2, the primary transfer roller 5 (5Y, 5C, 5M, and 5K) is disposed facing the photosensitive drum 2 via the intermediate transfer belt 4.

Next, a description is provided of an image forming operation.

A predetermined voltage, in which an alternating current (AC) voltage and a direct current (DC) voltage are superimposed, is supplied to the charging roller 15 from a power source, thereby charging the surface of the photosensitive drum 2 disposed opposite the charging roller 15. It is to be noted that the charging roller 15 includes rollers at each end thereof, thereby keeping the surface of the photosensitive drum 2 and the charging roller 15 spaced apart. That is, the photosensitive drum 2 and the charging roller 15 do not contact each other.

Subsequently, the writing unit 3 illuminates the surface of the photosensitive drum 2 charged to a predetermined potential with laser light L based on the image data, thereby forming an electrostatic latent image on the surface thereof. When the surface of the photosensitive drum 2 bearing the electrostatic latent image arrives at the developing unit 13, the developing roller 32 facing the photosensitive drum 2 supplies toner to the electrostatic latent image on the surface of the photosensitive drum 2, thereby forming a toner image.

According to the present illustrative embodiment, the charging method employed herein is a contactless charging method. Alternatively, the charging method may be of a contact charging method. The charging bias to be applied is not limited to the superimposed bias including the AC voltage and the DC bias superimposed. Alternatively, only the DC voltage may be applied.

The above-described image forming operation is performed in all of the image forming units 1Y, 1C, 1M, and 1K at predetermined timing, and the toner images are formed on each of the photosensitive drums 2Y, 2C, 2M, and 2K.

The toner images on the photosensitive drums 2Y, 2C, 2M, and 2K are transferred onto the intermediate transfer belt 4 such that they are superimposed one atop the other at predetermined timing in the image forming operation of the image forming units 1Y, 1C, 1M, and 1K. Accordingly, a composite toner image is formed on the intermediate transfer belt 4. A primary transfer bias is applied by a power source to the primary transfer rollers 5Y, 5C, 5M, and 5K, facing the photosensitive drums 2Y, 2C, 2M, and 2K, respectively, via the intermediate transfer belt 4, to transfer the toner images onto the surface of the intermediate transfer belt 4. This process is known as primary transfer. The primary transfer bias is a voltage having a polarity opposite that of the charged toner on the photosensitive drum 2. That is, in a case in which the polarity of the charged toner has a negative polarity, the primary transfer bias is a voltage having a positive polarity.

The recording medium P is fed either from the sheet cassette 10*a* or from the sheet cassette 10*b*, or from the side tray 10*c*. As the leading end of the recording medium P arrives at a pair of registration rollers 16, rotation of the pair of registration rollers 16 stops temporarily, hence stopping conveyance of the recording medium P. Rotation of the pair of registration rollers 16 resumes at the appropriate timing associated with the image forming operation described above. The recording medium P is transported to a secondary transfer portion defined by a transfer nip at which the intermediate transfer belt 4 and the secondary transfer roller 7 contact.

The composite toner image on the intermediate transfer belt 4 is transferred onto the recording medium P interposed in the transfer nip between the secondary transfer roller 7 and the intermediate transfer belt 4. The composite toner image is transferred onto the recording medium by applying the secondary transfer bias to the secondary transfer roller 7 by a power source. The secondary transfer bias is a voltage having a polarity opposite the charge polarity of toner on the intermediate transfer belt 4.

As the recording medium P passes through the transfer nip between the secondary transfer roller 7 and the intermediate transfer belt 4, the composite toner image is transferred onto the recording medium P. Subsequently, the recording medium P is conveyed to the fixing device 8.

The fixing device 8 includes a fixing roller 81 and a pressing roller 82 that presses against the fixing roller 81, thereby forming a fixing nip therebetween. A fixing belt is entrained around the fixing roller 81 and a heating roller having a heater inside thereof. In the fixing device 8, the composite toner image is fixed on the recording medium P as the recording medium P passes through the fixing nip between the fixing roller 81 and the pressing roller 82 where heat and pressure are applied.

When printing on one side of the recording medium P, the recording medium P is discharged outside the image forming apparatus 100 after passing through the fixing device 8 by a pair of output rollers. For double-sided printing, the recording medium P is sent to the conveyor unit 18. The recording medium P is reversed in the conveyor unit 18. Subsequently, the recording medium P is transported again to the secondary transfer portion by the pair of registration rollers 16 at appropriate timing.

After passing through the fixing device 8, the recording medium P is delivered either along a sheet transport path Pa or along a sheet transport path Pb indicated by broken lines in FIG. 1. More specifically, the recording medium P is delivered along the sheet transport path Pa in the single-sided printing and after double-sided printing. When printing on the rear surface or the second surface of the recording medium P in the double-sided printing, the recording medium P is delivered along the sheet transport path Pb which is a reverse transport path.

Figure 3:
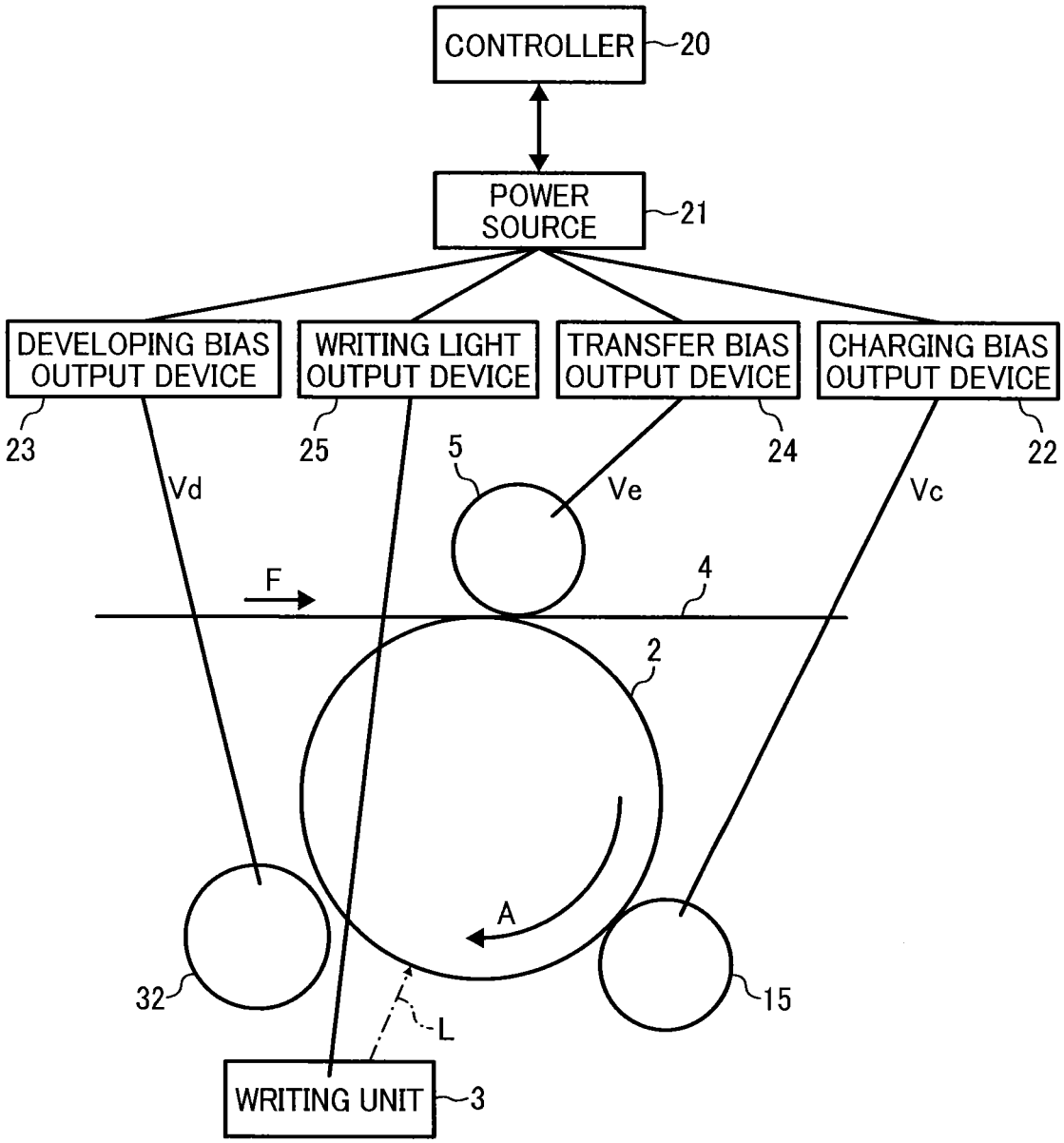
FIG. 3 is a block diagram illustrating a control system of the image forming apparatus that controls the image forming unit of FIG. 2.

With reference to FIG. 3, a description is provided of a control system that controls application of different biases in the image forming units 1Y, 1C, 1M, and 1K. FIG. 3 is a block diagram illustrating the control system of the image forming apparatus 100. Parts that are similar to or the same as those shown in the previously described figures are given the same reference numbers, and the description thereof is omitted.

In FIG. 3, a controller 20 controls the entire image forming apparatus 100 shown in FIG. 1. The controller 20 includes a microprocessor consisting of, for example, a central processing unit (CPU), a Read Only Memory (ROM), and a Random Access Memory (RAM).

The controller 20 controls a power source 21 which supplies power to a charging bias output device 22, a developing bias output device 23, a transfer bias output device 24, and a writing light output device 25.

The charging bias output device 22 applies a charging bias Vc (a negative high voltage) to the charging roller 15 to charge the surface (photosensitive surface) of the photosensitive drum 2.

The writing light output device 25 outputs a light-emission signal to the writing unit 3, thereby enabling a laser diode serving as a light source to emit light through a driver circuit. Accordingly, the laser light L for writing is emitted. Prior to this, the power source 21 supplies a driving current to a polygon motor of the writing unit 3, thereby enabling a polygon mirror to rotate fast. The laser light L strikes the polygon mirror and scans the photosensitive drum 2 in the axial direction (main scanning direction) while the photosensitive drum 2, which has been charged, rotates. Accordingly, an electrostatic latent image is formed on the surface thereof.

The developing bias output device 23 outputs a developing bias Vd (a negative voltage) to the developing roller 32, thereby charging toner in the developing agent carried on the outer circumferential surface of the developing roller 32. An exposed portion of the electrostatic latent image includes pixels with the negative charge, the polarity of which has dropped. The charged toner contacts the surface of the photosensitive drum 2 and adheres to such pixels, thereby forming a toner image on the surface of the photosensitive drum 2.

The transfer bias output device 24 outputs a primary transfer bias Ve (a positive voltage opposite the charge polarity of the toner image) to the primary transfer roller 5 to attract the toner image on the surface the photosensitive drum 2 towards the primary transfer roller 5. Accordingly, the toner image is transferred onto the intermediate transfer belt 4.

The power source 21 supplies power to a main motor for rotating the photosensitive drum 2 at a predetermined peripheral speed (process speed) in the direction of arrow A, and a motor and/or a clutch for rotating the intermediate transfer belt 4 in the direction of arrow F at the same process speed. Furthermore, the power source 21 supplies power to a motor and a clutch for rotating the developing roller 32 and the screw 33 of the developing unit 13. The power source 21 also supplies power to the sheet feed roller and the conveyor roller shown in FIG. 1, a motor and a clutch for rotating the pair of registration rollers 16, the fixing roller 81 of the fixing unit 8.

The charging bias output device 22, the developing bias output device 23, and the transfer bias output device 24 output a respective bias voltage to the charging roller 15, the developing roller 32, and the primary transfer roller 5 of the image forming units 1Y, 1C, 1M, and 1K. Furthermore, the charging bias output device 22 outputs a secondary transfer bias to the secondary transfer roller 7 in predetermined timing.

In the present illustrative embodiment, a description is provided of a tandem-type color printer using four image forming units arranged in tandem and the intermediate transfer method using the intermediate transfer member as an example of the image forming apparatus. However, the image forming apparatus is not limited thereto. The image forming apparatus includes, but is not limited to, a tandem-type image forming apparatus using a direct transfer method and an image forming apparatus other than the tandem-type image forming apparatus using four image forming units. Furthermore, the image forming apparatus may be a revolver-type color printer. The intermediate transfer member may be a drum type.

The image forming apparatus may be a color or a monochrome electrophotographic image forming apparatus such as a multifunction system including at least one of functions of printing, copying, facsimile, and so forth.

The transfer device employed in the image forming apparatus of the direct transfer method and the monochrome image forming apparatus transfers only the toner image formed on the photosensitive member. Therefore, the transfer device does not need to be distinguished between the primary and the secondary transfer devices. In the case of the tandem-type color image forming apparatus using the direct transfer method, the image forming apparatus of this type includes a transfer-conveyor belt, instead of the intermediate transfer belt, to transport the recording medium such as transfer paper by absorbing the recording medium to the surface of the belt while transferring toner images from the photosensitive members onto the recording medium.

In the image forming apparatus 100 the transfer bias is supplied when the charging start position of the surface of the photosensitive drum arrives at the transfer position such as in the known image forming apparatus described above with reference to FIG. 10.

Figure 4:
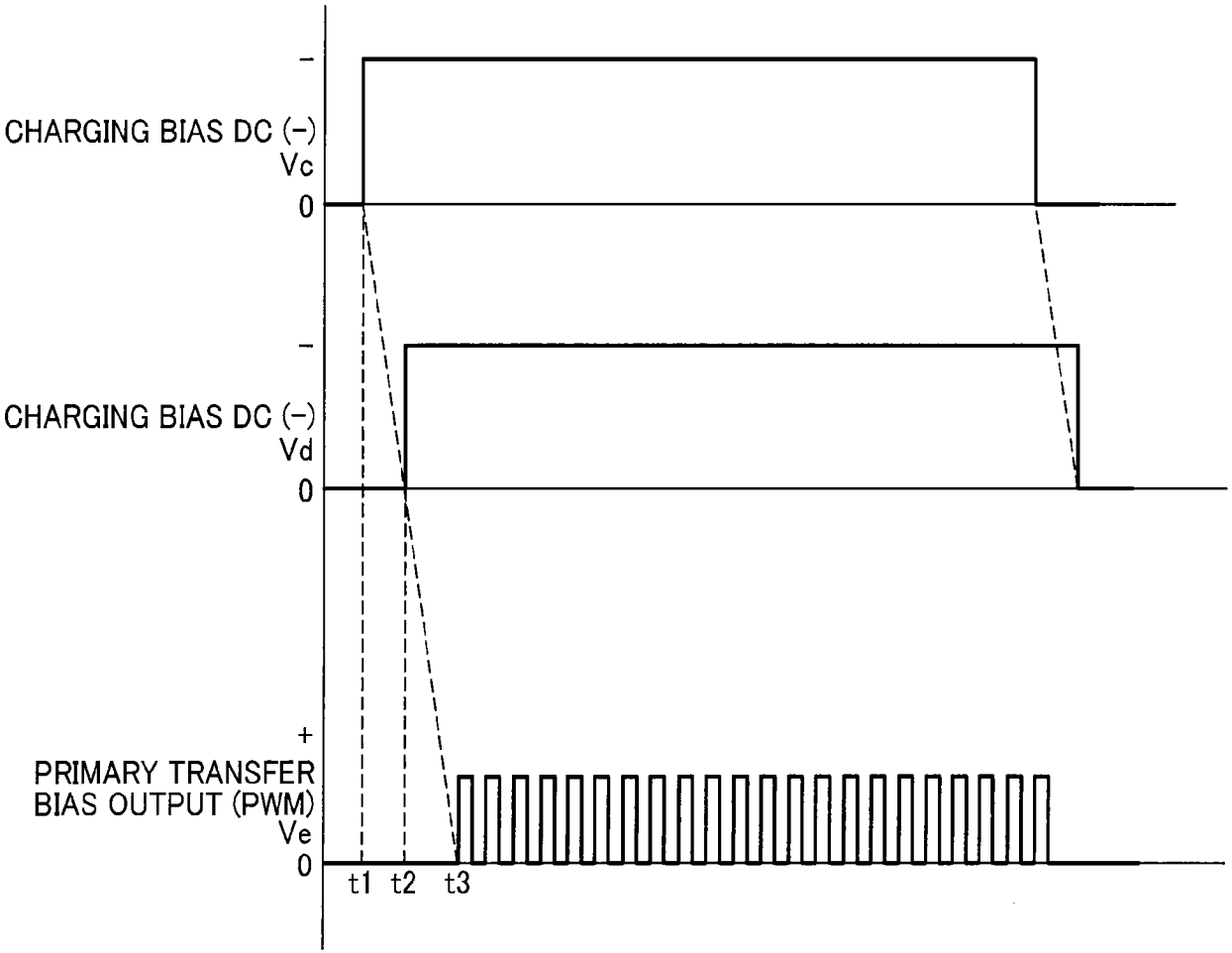
FIG. 4 RELATED ART
FIG. 4 is an example of a timing chart showing output waveforms and output timings of a charging bias, a developing bias, and a primary transfer bias in a related-art electrophotographic image forming apparatus.
Figure 5:
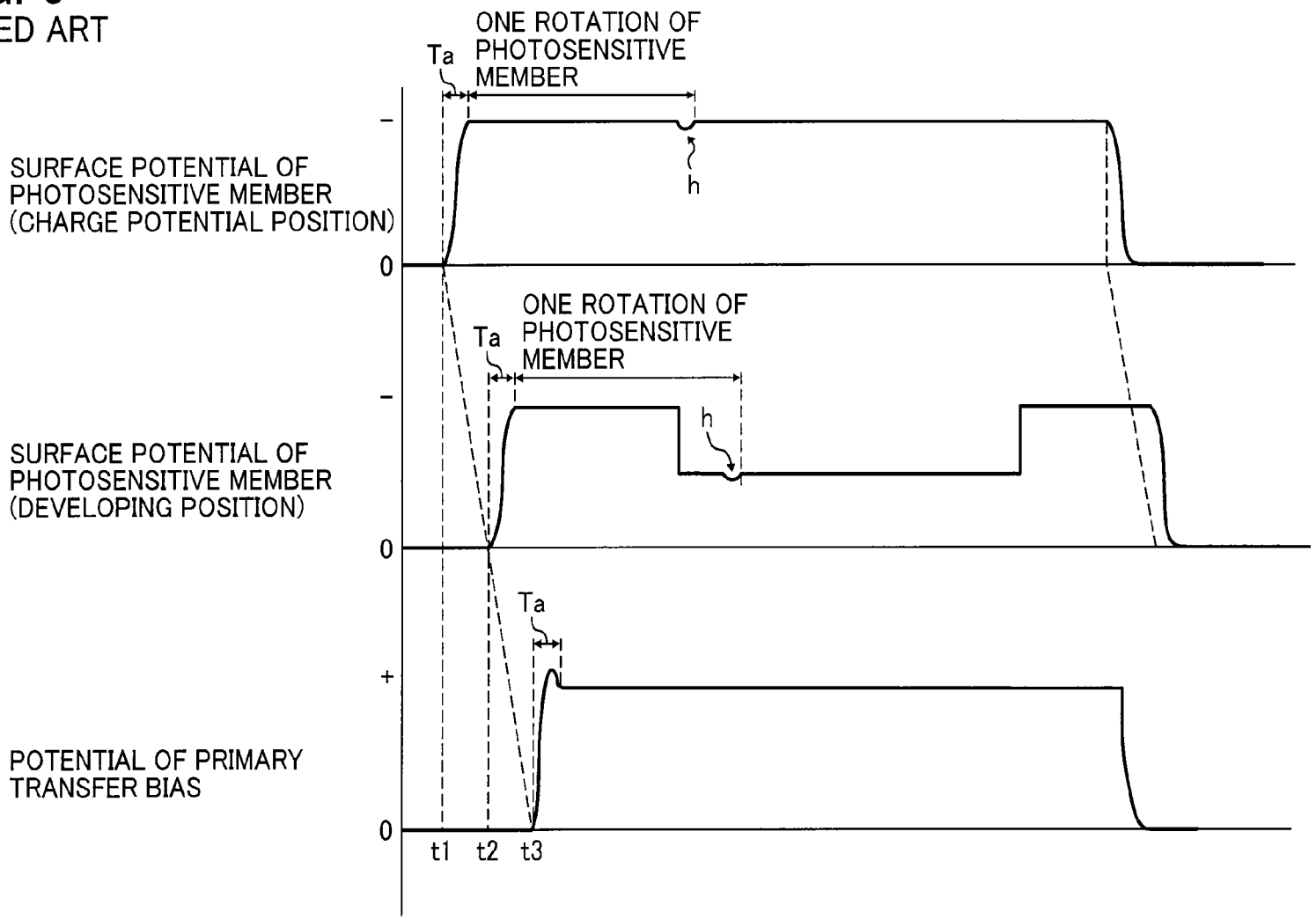
FIG. 5 RELATED ART
FIG. 5 is a timing chart showing changes in a surface potential of a photosensitive member and a potential of the primary transfer bias at a charging position and a developing position in the related-art electrophotographic image forming apparatus.
Figure 10:
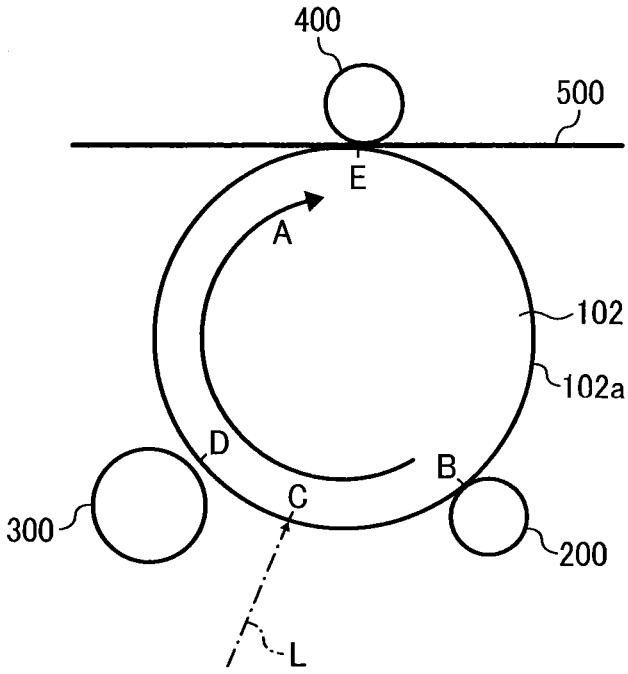
FIG. 10 RELATED ART
FIG. 10 is a schematic diagram illustrating a related-art image forming unit and positions of charging, developing, and transferring according to the related-art electrophotographic image forming apparatus.

In order to facilitate an understanding of the novel features of the present invention, with reference to FIGS. 4 and 5, as a comparison a description is provided of waveforms of each bias in the related-art image forming apparatus shown in FIG. 10. For the sake of convenience, the description is provided using the same reference numbers used in FIG. 3.

FIG. 4 shows an example of a timing chart showing output waveforms and output timings of the charging bias, the developing bias, and the primary transfer bias in the related-art image forming apparatus.

At a time t1, the charging bias output device 22 starts supplying the charging bias (negative DC voltage) Vc to the charging roller 15 and continues to supply until a series of image forming operation is finished.

Subsequently, at a time t2, the developing bias output device 23 starts supplying the developing bias (negative DC voltage) Vd to the developing roller 32 and stops supplying after a laps of a time "t2−t1" from the time at which the charging bias output device 22 stops supplying the charging bias Vc. The time t2−t1 corresponds to d1/v, where v is a process speed which is a surface movement speed of the photosensitive drum 2 and d1 is a circumferential distance of the photosensitive drum 2 in the circumferential direction thereof from the charging start position to the developing position as explained with reference to FIG. 10.

Subsequently, at a time t3, the transfer bias output device 24 starts to apply the primary transfer bias Ve to the primary transfer roller 5. The time t3 is expressed by the following equation: t3−t1=d2/v, where d2 is a circumferential distance of the photosensitive drum 2 in the circumferential direction from the charging position to the transfer position as explained with reference to FIG. 10.

The transfer bias output device 24 supplies the primary transfer bias Ve after the charging bias output device 22 starts supplying the charging bias Vc and when a position (hereinafter referred to as a charging start position) of the surface of the photosensitive drum 2 at which the photosensitive drum 2 starts to be charged by the charging roller 15 arrives at the transfer position of the primary transfer roller 5. The charging start position refers to a position of the photosensitive drum 2 at which the charging roller 15 starts charging the photosensitive drum 2.

The charging bias output device 22, the developing bias 23, and the transfer bias output device 24 are controlled by the controller 20 via the power source 21.

The primary transfer bias Ve includes a positive voltage in pulses having a constant crest value, controlled by pulse-width modulation (PWM). An effective voltage is determined based on a duty (i.e., a ratio (%) of ON time in one cycle) of the voltage. However, in this case, the primary transfer bias maintains the same duty from the rise time thereof until the completion of the image forming operation as shown in FIG. 4, When the charging start position of the photosensitive drum 2 at which charging of the photosensitive drum 2 has started at the time t1 arrives at the developing position at the time t2, the developing bias starts to be output. When the charging start position arrives at the transfer position at the time t3, the primary transfer bias starts to be supplied. In other words, the primary transfer bias is supplied when the charging start position of the photosensitive drum 2 arrives at the transfer position.

Accordingly, the trace of output of the primary transfer bias is prevented from appearing in an image area. With this configuration, even when writing is started at the time at which the first charging start position of the photosensitive drum 2 arrives at the writing position, an undesirable horizontal streak due to irregular toner density is prevented from appearing. Furthermore, because the image forming operation can be started immediately after charging, the first image output time (FCOT) is shortened significantly.

FIG. 5 is a timing chart showing changes in the surface potential of the photosensitive drum 2 and the potential of the primary transfer bias at the charging position and the developing position in the known electrophotographic image forming apparatus.

In the known configuration, regardless of the charging method, i.e., a contact type charging method or a contact-free charging method, a rise time Ta is approximately 100 ms when supplying the charging bias to known charging rollers. The surface potential of the photosensitive drum 2 follows this, accordingly. The rise time Ta, therefore, is from the time at which the charging bias output device 22 supplies the charging bias to the charging roller 15 to the time at which the surface potential of the photosensitive drum 2 reaches the predetermined potential.

The rise time of the surface potential of the photosensitive drum 2 at the developing position has the same waveform.

The primary transfer bias is controlled to maintain a preset current value (corresponding to a voltage value) or a preset voltage value by constant current control or constant voltage control by the power source 21 and the transfer bias output device 24. However, when applying the primary transfer bias to the surface of the photosensitive drum 2 having the surface potential with the rise time Ta such as that shown in FIG. 5, the response of the power source 21 and the transfer bias output device 24 is delayed regardless of the constant current control or the constant voltage control. This is because resistance (load) relative to the power source 21 changes significantly at a portion of the photosensitive drum 2 with the surface potential thereof having been changed.

As a result, overshoot occurs in the primary transfer bias, and the primary transfer bias stabilizes. More specifically, the potential of the primary transfer bias exceeds a specified value by 10% to 20% for the time period of approximately 50 ms, which is half the rise time Ta.

The surface potential of the portion of the photosensitive drum 2 associated with the area at which overshoot has occurred becomes more positive than the surface potential of the stabilized portion of photosensitive drum 2. As a result, the trace of the primary transfer bias remains even after the subsequent charging, i.e., the second charging. A depressed portion indicated by a reference character "h" in the waveform of the surface potential of the photosensitive drum at the charging position and the developing position shown in FIG. 5 indicates the trace of the primary transfer bias. An absolute value of the surface potential of the photosensitive drum at the developing position drops substantially in the middle of the waveform. This indicates an example of the area at which a uniform halftone image is formed.

Figure 6:
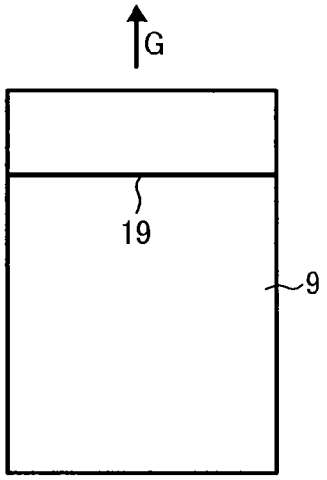
FIG. 6 RELATED ART
FIG. 6 is a schematic diagram illustrating an example of a horizontal black streak appeared in an image formed on a recording medium in the related-art image forming apparatus having the timing charts shown in FIGS. 4 and 5.

The trace of the primary transfer bias appeared as the depressed portion h in the waveform is more positive than the stabilized potential before and after the depressed portion h. Consequently, a relatively large amount of toner is adhered to a toner image formed in the area having the trace of the primary transfer bias at the first charging, and the toner image is primarily transferred onto the intermediate transfer belt 4. The toner image is then transferred secondarily onto the recording medium P. As a result, as illustrated in FIG. 6, a horizontal black streak 19 appears in an image formed on the first sheet of the recording medium P. The transport direction of the recording medium P is indicated by a reference character "G" in FIG. 6.

Figure 7:
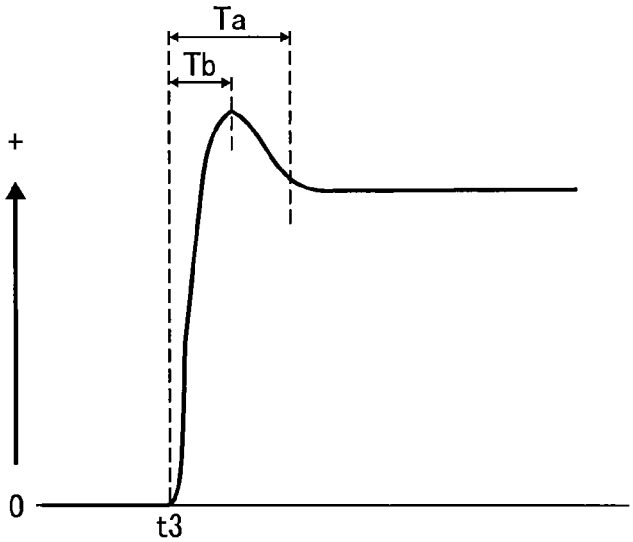
FIG. 7 RELATED ART
FIG. 7 is a partially enlarged chart showing a rise time of the potential of the primary transfer bias shown in FIG. 5.
Figure 8:
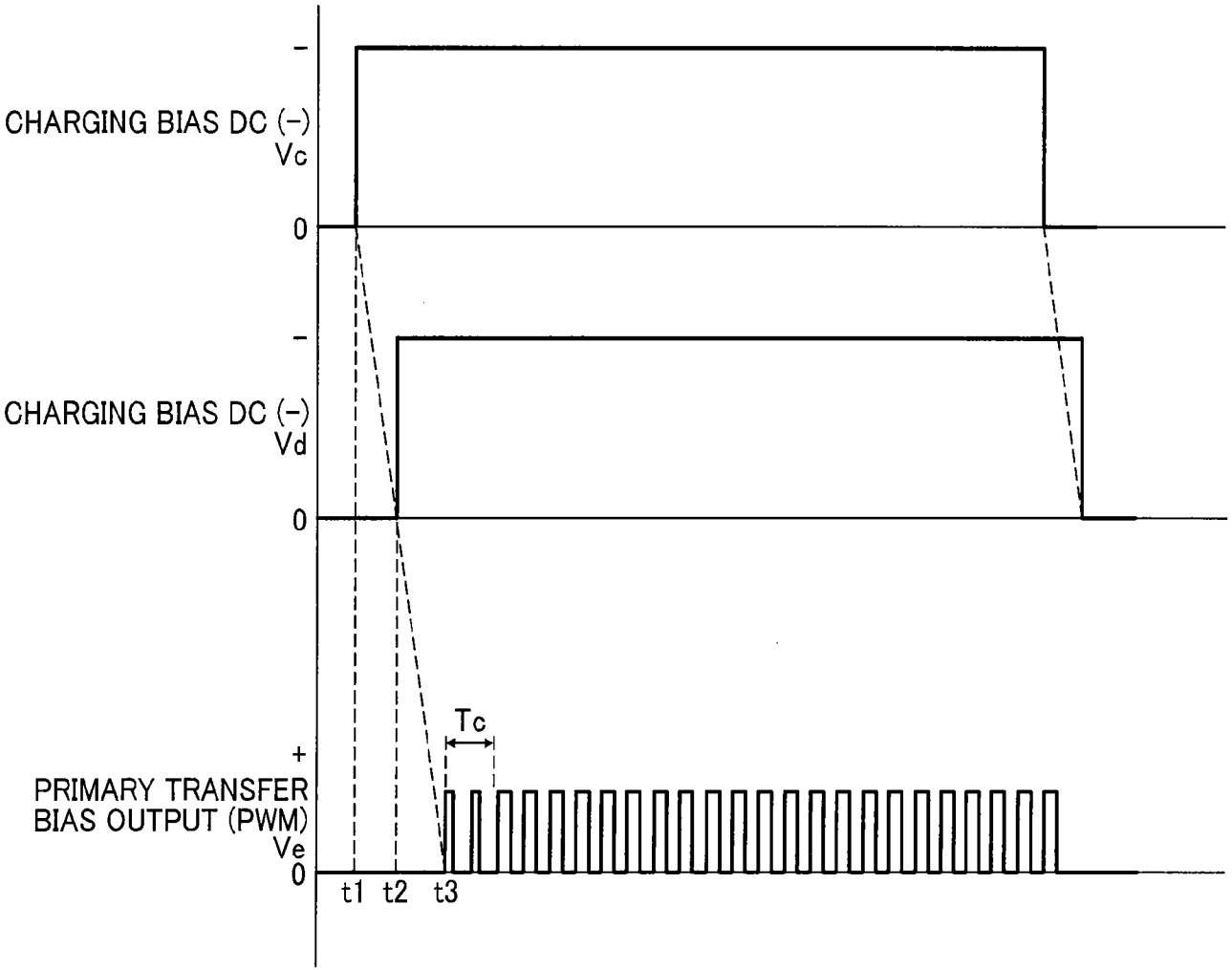
FIG. 8 is an example of a timing chart showing output waveforms and output timings of a charging bias, a developing bias, and a primary transfer bias in an electrophotographic image forming apparatus according to an illustrative embodiment of the present disclosure.
Figure 9:
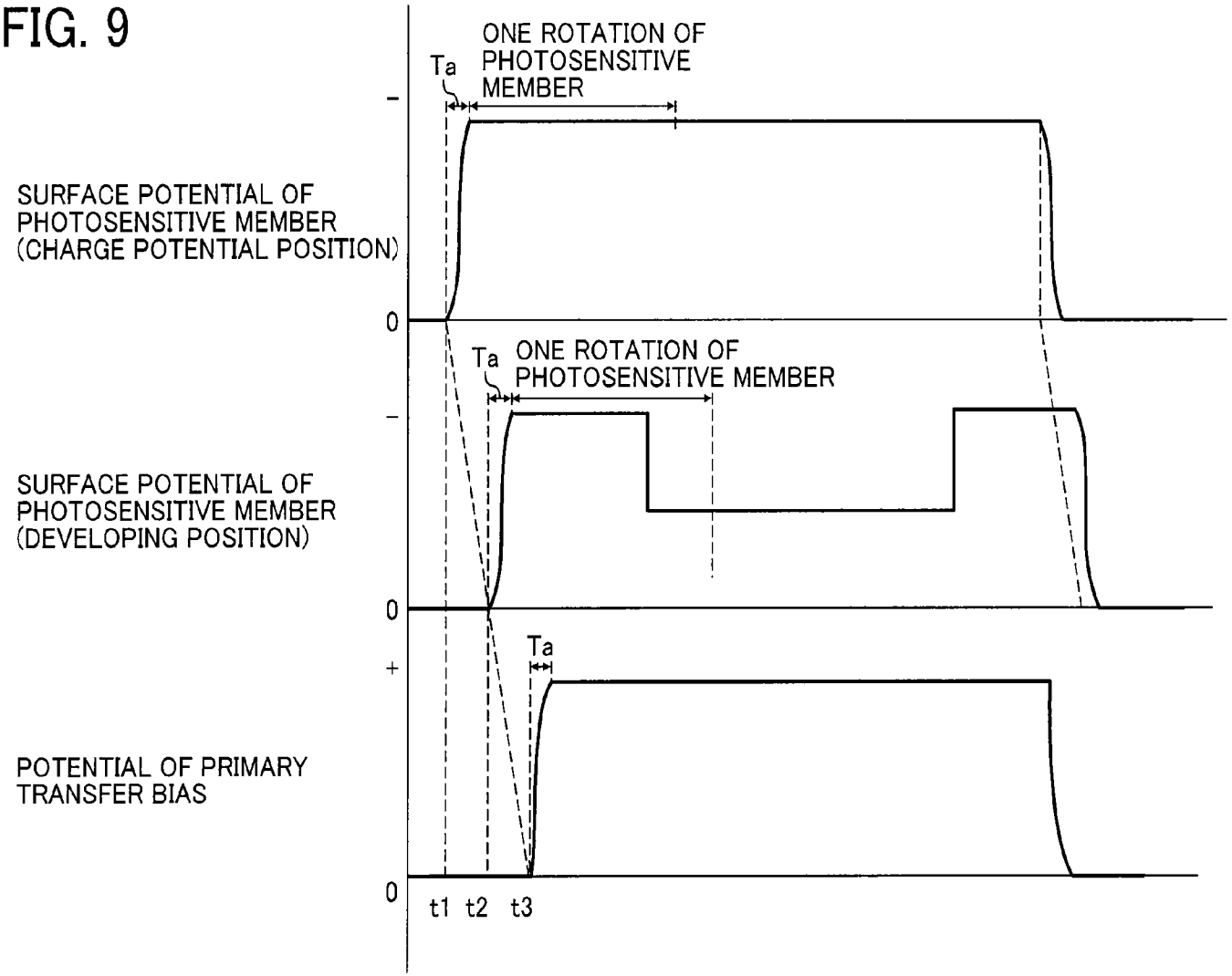
FIG. 9 is a timing chart showing changes in the surface potential of the photosensitive member and the potential of the primary transfer bias at the charging position and the developing position in the image forming apparatus according to an illustrative embodiment of the present disclosure.

With reference to FIGS. 7 through 9, a description is provided of control of the primary transfer bias according to the illustrative embodiment of the present disclosure.

According to the illustrative embodiment of the present disclosure, similar to the known control described above, the primary transfer bias is supplied when the charging start position of the photosensitive drum 2 arrives at the transfer position during a preparation time for image formation in the image forming units. However, when the transfer bias output device 24 shown in FIG. 3 starts supplying the primary transfer bias to the primary transfer roller 5, the voltage is not set to a normal set value which is a value employed upon image formation, but is set to a voltage lower than the normal value for a predetermined time period. After the predetermined time period, the voltage is set to the normal set value. In other words, the transfer bias is supplied in two steps, thereby preventing overshoot at the rising of the primary transfer bias.

FIG. 8 is an example of a timing chart showing output waveforms and output timings of the charging bias, the developing bias, and the primary transfer bias in the image forming apparatus according to an illustrative embodiment of the present disclosure. FIG. 9 is a timing chart, similar to FIG. 5, showing changes in the surface potential of the photosensitive drum and the potential of the primary transfer bias at the charging position and the developing position in the image forming apparatus according to an illustrative embodiment of the present disclosure. The output waveforms of the charging bias Vc and the developing bias Vd, and the time t1 and the time t2 shown in FIG. 8 are similar to FIG. 4.

The transfer bias output device 24 shown in FIG. 3 supplies the primary transfer roller 5 with the primary transfer bias Ve at the time t3 similar to FIG. 4. The primary transfer bias Ve includes a positive voltage in pulses having a constant crest value, controlled by pulse-width modulation (PWM). However, as illustrated in FIG. 8, between the output start time t3 and a predetermined time Tc, the duty (%) of the primary transfer bias Ve is set to be smaller than the subsequent normal duty set value, and the effective voltage is lower than the normal set value which is a value employed upon image formation.

Accordingly, as illustrated in FIG. 9, overshoot does not occur in the primary transfer bias at the rise rising of the primary transfer bias potential. Thus, immediately after rising, the primary transfer potential achieves the normal transfer potential. The rise time coincides with the rise time Ta of the surface potential of the photosensitive drum 2. With this configuration, the trace of partial drop in the potential such as shown in FIG. 5 indicated as h does not occur in the surface potential of the photosensitive drum 2 at the charging position and the developing position. Thus, a thin black streak 19 as shown in FIG. 6 is not generated in an output image on the first sheet of the recording medium.

In FIG. 9, an absolute value of the surface potential of the photosensitive drum 2 at the developing position drops substantially at the center of the waveform. It shows an example of an area at which a uniform halftone image is formed.

The rise time Ta of the surface potential of the photosensitive drum 2 depends on the configuration of the image forming apparatus. When setting the primary transfer bias output value to the normal set value from the beginning of image formation such as shown in FIG. 4 which shows example output timings of biases in the known image forming apparatus, the primary transfer bias potential rises as illustrated in FIG. 7, and is stabilized at a normal potential after overshoot. The rise time Ta corresponds to the time required for this action. Therefore, the required time depends on the rise time Ta of the surface potential of the photosensitive drum 2. In general, the time is always substantially constant in the same image forming apparatus.

In view of the above, the predetermined time Tc (see FIG. 8), during which the duty of the primary transfer bias output is reduced so as to make the effective voltage thereof below the normal voltage, is set to an appropriate time so that the overshoot does not occur within a time corresponding to the rise time Ta of the surface potential of the photosensitive drum. For example, in a case in which the primary transfer bias output is set to the normal set value (voltage), which is the value employed at the image formation, from the beginning as in the known image forming apparatus, as illustrated in FIG. 7, the following relation is satisfied: Tc=Tb, where Tb is a time from the time t3 at which the primary transfer bias Ve starts to be supplied to the peak of the overshoot.

In a case in which the rise time Ta is 100 ms, the time Tb is approximately 50 ms, which is approximately half the time Ta. Thus, the time Tc is set to 50 ms, which is effective. Alternatively, the time Tc may be set in a range of from the time Tb (50 ms) and the time Ta (100 ms).

Although the ratio of reduction of the effective voltage relative to the normal voltage by reducing the duty of the primary transfer bias output depends on the degree of overshoot that occurs upon output of the known primary transfer bias, the ratio can be in a range of from 50% to 80% of the normal primary transfer bias voltage. For example, when the above-described predetermined time is set to 50 ms, the initial primary transfer bias voltage is set to approximately 80% of the normal voltage.

As illustrated in FIG. 8, in a case in which the primary transfer bias output is a voltage subjected to pulse-width modulation (PWM) control, the duty thereof is set to 80% of the normal duty at the image formation (printing) for 50 ms from the output start time t3. In the case of constant voltage control, the duty under the pulse-width modulation (PWM) control is set such that for the initial time period of 50 ms the duty is reduced by 20% or set to 80% of the primary transfer bias voltage employed at the time of image formation. In the case of the constant current control, the duty under the pulse-width modulation (PWM) control is set such that for the initial time period of 50 ms the duty is reduced by 20% or set to 80% of the primary transfer bias current employed at the time of image formation.

The initial primary transfer bias output value is set to a value which is smaller by a preset ratio relative to the normal set value at the time of image formation. With this configuration, changes in the normal set value at the time of image formation due to environmental changes such as a temperature and humidity change in the image forming apparatus caused by ambient variation and usage can be accommodated automatically.

However, the degree (size) of overshoot at the rising of the primary transfer bias potential depends also on the material and the thickness of the surface of the primary transfer roller 5 and the photosensitive drum 2. Preferably, the predetermined time period Tc during which the output voltage of the primary transfer bias is reduced initially and the ratio of reduction of the output voltage of the primary transfer bias are obtained by performing experiments for each type of machine.

It is to be noted that the rise time Ta of the surface potential of the photosensitive drum is determined deliberately upon designing of the image forming apparatus in such a manner that the rise of the developing bias potential can follow. The process speed, which is a surface moving speed of the photosensitive drum determined by the rotation speed thereof, can be determined upon designing.

If the value of the surface potential of the photosensitive drum after rising is the same as the value before rising, the shorter is the rise time Ta or the faster is the process speed, the surface potential of the photosensitive drum changes sharply upon rising.

By contrast, the longer is the rise time Ta of the surface of the photosensitive drum or the slower is the process speed v, the surface potential of the photosensitive drum changes gradually upon rising. Thus, the degree of overshoot is small upon rising of the conventional charging bias potential.

Therefore, preferably, the ratio of reduction of the initial value of the primary transfer bias output relative to the predetermined set value is set in accordance with the rise time Ta of the surface potential of the photosensitive drum or the process speed v.

In this case, the shorter is the rise time Ta of the surface potential of the photosensitive drum or the faster is the process speed v, the ratio of reduction of the initial value of the primary transfer bias output relative to the predetermined set value is increased such as from 20% to 30%, thereby reducing the initial value by 10%, that is, from 80% to 70% of the predetermined set value. By contrast, the longer is the rise time Ta of the surface potential of the photosensitive drum or the slower is the process speed v, the ratio of reduction of the initial value of the primary transfer bias output relative to the predetermined set value is reduced, for example, from 20% to 10%. Accordingly, the initial value is increased from 80% to 90% of the predetermined set value.

In a case in which the rise time Ta of the surface potential of the photosensitive drum or the process speed v is changeable while the image forming apparatus is in operation, the controller 20 shown in FIG. 3 verifies the change, and the initial value of the transfer bias output by the bias output device 24 can be changed in the above-described manner.

In terms of the absolute value of the surface potential of the photosensitive drum corresponding to the charging bias voltage Vc, the greater is the absolute value, the more sharply the surface potential of the photosensitive drum changes at the time of rising, thereby increasing the degree of overshoot. Therefore, the ratio of reduction of the initial value of the primary transfer bias output relative to the predetermined set value can be changed in accordance with the charging bias voltage Vc.

The charging bias voltage Vc may be changed due to adjustment of image density while the image forming apparatus is in operation. When the absolute value of the charging bias voltage Vc is increased, the ratio of reduction of the initial value of the primary transfer bias output relative to the predetermined set value is increased (the ratio relative to the predetermined set value is reduced). By contrast, in a case in which the absolute value of the charging bias voltage Vc is reduced, the ratio of reduction of the initial value of the primary transfer bias output relative to the predetermined set value is reduced (the ratio relative to the predetermined set value is increased).

Such control of primary transfer bias output is carried out by the controller 20. More specifically, the controller 20 controls the transfer bias output device 24 via the power source 21 as illustrated in FIG. 3.

In the image forming apparatus of the present illustrative embodiment, the controller 20 shown in FIG. 3 controls the power source 21 and the charging bias output device 22 to enable the charging roller 15 to start supplying a normal charging bias from a state in which the charging roller 15 does not output the charging bias. Furthermore, the controller 20 controls the power source 21 and the transfer bias output device 24 to enable the primary transfer roller 5 to start supplying the primary transfer bias from a state in which the primary transfer roller 5 does not output the primary transfer bias.

Depending on the image forming apparatus, the charging bias output device enables a charger such as a charging roller to start supplying a normal charging bias in a state in which the charger has supplied a charging bias which is smaller than the normal charging bias. Depending on the transfer bias output device, the transfer bias output device enables a transfer device such as a primary transfer roller to supply a transfer bias in a state in which the transfer device has supplied a bias which is significantly smaller than the transfer bias.

In such a case, conventionally, as a transfer bias that can transfer the toner image, the normal transfer bias is supplied from the start of supply of the transfer bias. As a result, overshoot occurs at the rising of the transfer bias potential. Therefore, the illustrative embodiments of the present disclosure can be applied to such an image forming apparatus.

In this case, the rise time Ta of the surface potential of the photosensitive drum is defined as a time from the start of supply of the normal charging bias to a time at which the surface potential of the photosensitive drum reaches the predetermined potential. Therefore, the initial value of the transfer bias is controlled to be less than the normal set value for the predetermined time period Tc which is a time after the transfer bias starts to be supplied and within a time corresponding to the rise time Ta during which the surface potential of the photosensitive member reaches the predetermined level after the charging bias starts to be output.

The image forming apparatus according to the illustrative embodiment described above is an example of a tandem-type color laser printer using an intermediate transfer method. However, the image forming apparatus is not limited thereto. The present disclosure can be applied to various types of electrophotographic image forming apparatuses. For example, the image forming apparatus includes, but is not limited to a tandem-type color image forming apparatus using a direct transfer method and a monochrome image forming apparatus. In such a case, the transfer bias is supplied to the transfer device to transfer the toner image formed on the photosensitive member to a recording medium in the similar or the same manner as outputting the primary transfer bias in the present illustrative embodiment.

The transfer device includes, but is not limited to, a transfer roller. For example, the transfer device may be a transfer charger. The photosensitive member includes, but is not limited to, a photosensitive drum. For example, the photosensitive member may be a photosensitive belt.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus comprising:

a photosensitive member to bear an electrostatic latent image on a surface thereof;

a charging device to charge the surface of the photosensitive member;

an exposure device to illuminate a charged surface of the photosensitive member to form an electrostatic latent image on the surface of the photosensitive member;

a developing device to develop the electrostatic latent image using toner to form a toner image;

a transfer device to transfer the toner image from the photosensitive member to a transfer medium at a transfer position;

a charging bias output device to supply a charging bias to the charging device;

a developing bias output device to supply a developing bias to the developing device;

a transfer bias output device to supply a transfer bias to the transfer device; and a controller operatively connected to the charging bias output device, the developing bias output device, and the transfer bias output device to control the charging bias output device, the developing bias output device, and the transfer bias output device, the controller controlling the transfer bias output device to supply the transfer bias from a time at which a first position of the photosensitive member arrives at the transfer position after the charging bias output device starts supplying the charging bias, an initial value of the transfer bias being controlled to be smaller than a normal set value for a predetermined time period which is a time after the transfer bias starts to be supplied and within a time corresponding to a rise time during which a surface potential of the photosensitive member reaches a predetermined potential after the charging bias starts to be output, wherein the first position of the photosensitive member is a position at which the charging device starts charging the photosensitive member, and wherein the initial value of the transfer bias is smaller than the normal set value by a predetermined ratio set in accordance with the rise time, and as the rise time becomes shorter, the predetermined ratio becomes greater.

2. The image forming apparatus according to claim 1, wherein the predetermined time period is within the rise time and is equal to or longer than half the rise time.

3. The image forming apparatus according to claim 1, wherein in a case in which the normal set value of the transfer bias is supplied as the transfer bias starts to be supplied, the predetermined time period is from a time at which the transfer bias starts to be supplied to a time at which a transfer bias potential reaches a peak of overshoot.

4. The image forming apparatus according to claim 1, wherein the transfer medium is an intermediate transfer belt.

5. The image forming apparatus according to claim 1, wherein the transfer medium is a recording medium.

6. The image forming apparatus according to claim 1, wherein the first position of the photosensitive member is a position at which the charging device starts charging normally the photosensitive member.

7. The image forming apparatus according to claim 6, wherein in a state in which the charging bias output device does not supply the charging bias the controller controls the charging bias output device to start supplying a normal charging bias, and wherein in a state in which the transfer bias output device does not supply a first transfer bias the controller controls the transfer bias output device to supply the first transfer bias.

8. The image forming apparatus according to claim 6, wherein in a case in which the normal set value of the transfer bias is supplied as a first transfer bias starts to be supplied, the predetermined time period is from a time at which the first transfer bias starts to be supplied to a time at which a transfer bias potential reaches a peak of overshoot.

9. An image forming apparatus comprising:

a photosensitive member to bear an electrostatic latent image on a surface thereof;

a charging device to charge the surface of the photosensitive member;

an exposure device to illuminate a charged surface of the photosensitive member to form an electrostatic latent image on the surface of the photosensitive member;

a developing device to develop the electrostatic latent image using toner to form a toner image;

a transfer device to transfer the toner image from the photosensitive member to a transfer medium at a transfer position;

a charging bias output device to supply a charging bias to the charging device;

a developing bias output device to supply a developing bias to the developing device;

a transfer bias output device to supply a transfer bias to the transfer device; and a controller operatively connected to the charging bias output device, the developing bias output device, and the transfer bias output device to control the charging bias output device, the developing bias output device, and the transfer bias output device, the controller controlling the transfer bias output device to supply the transfer bias from a time at which a first position of the photosensitive member arrives at the transfer position after the charging bias output device starts supplying the charging bias, an initial value of the transfer bias being controlled to be smaller than a normal set value for a predetermined time period which is a time after the transfer bias starts to be supplied and within a time corresponding to a rise time during which a surface potential of the photosensitive member reaches a predetermined potential after the charging bias starts to be output, wherein the first position of the photosensitive member is a position at which the charging device starts charging the photosensitive member, and wherein the initial value of the transfer bias is smaller than the normal set value by a predetermined ratio set in accordance with a process speed which coincides with a surface movement speed of the photosensitive member, and as the process speed becomes faster, the predetermined ratio becomes greater.

10. The image forming apparatus according to claim 9, wherein the predetermined time period is within the rise time and is equal to or longer than half the rise time.

11. The image forming apparatus according to claim 9, wherein in a case in which the normal set value of the transfer bias is supplied as the transfer bias starts to be supplied, the predetermined time period is from a time at which the transfer bias starts to be supplied to a time at which a transfer bias potential reaches a peak of overshoot.

12. The image forming apparatus according to claim 9, wherein the transfer medium is an intermediate transfer belt.

13. The image forming apparatus according to claim 9, wherein the transfer medium is a recording medium.

14. The image forming apparatus according to claim 9, wherein the first position of the photosensitive member is a position at which the charging device starts charging normally the photosensitive member.

15. The image forming apparatus according to claim 14, wherein in a state in which the charging bias output device does not supply the charging bias the controller controls the charging bias output device to start supplying a normal charging bias, and wherein in a state in which the transfer bias output device does not supply a first transfer bias the controller controls the transfer bias output device to supply the first transfer bias.

16. The image forming apparatus according to claim 14, wherein in a case in which the normal set value of the transfer bias is supplied as a first transfer bias starts to be supplied, the predetermined time period is from a time at which the first transfer bias starts to be supplied to a time at which a transfer bias potential reaches a peak of overshoot.

17. An image forming apparatus comprising:

a photosensitive member to bear an electrostatic latent image on a surface thereof;

a charging device to charge the surface of the photosensitive member;

an exposure device to illuminate a charged surface of the photosensitive member to form an electrostatic latent image on the surface of the photosensitive member;

a developing device to develop the electrostatic latent image using toner to form a toner image;

a transfer device to transfer the toner image from the photosensitive member to a transfer medium at a transfer position;

a charging bias output device to supply a charging bias to the charging device;

a developing bias output device to supply a developing bias to the developing device;

a transfer bias output device to supply a transfer bias to the transfer device; and a controller operatively connected to the charging bias output device, the developing bias output device, and the transfer bias output device to control the charging bias output device, the developing bias output device, and the transfer bias output device, the controller controlling the transfer bias output device to supply the transfer bias from a time at which a first position of the photosensitive member arrives at the transfer position after the charging bias output device starts supplying the charging bias, an initial value of the transfer bias being controlled to be smaller than a normal set value for a predetermined time period which is a time after the transfer bias starts to be supplied and within a time corresponding to a rise time during which a surface potential of the photosensitive member reaches a predetermined potential after the charging bias starts to be output, wherein the first position of the photosensitive member is a position at which the charging device starts charging the photosensitive member, and wherein the initial value of the transfer bias is smaller than the normal set value by a predetermined ratio set in accordance with a voltage value of the charging bias, and as the voltage value becomes greater, the ratio becomes greater.

18. The image forming apparatus according to claim 17, wherein the predetermined time period is within the rise time and is equal to or longer than half the rise time.

19. The image forming apparatus according to claim 17, wherein in a case in which the normal set value of the transfer bias is supplied as the transfer bias starts to be supplied, the predetermined time period is from a time at which the transfer bias starts to be supplied to a time at which a transfer bias potential reaches a peak of overshoot.

20. The image forming apparatus according to claim 17, wherein the transfer medium is an intermediate transfer belt.

21. The image forming apparatus according to claim 17, wherein the transfer medium is a recording medium.

22. The image forming apparatus according to claim 17, wherein the first position of the photosensitive member is a position at which the charging device starts charging normally the photosensitive member.

23. The image forming apparatus according to claim 22, wherein in a state in which the charging bias output device does not supply the charging bias the controller controls the charging bias output device to start supplying a normal charging bias, and wherein in a state in which the transfer bias output device does not supply the first transfer bias the controller controls the transfer bias output device to supply a first transfer bias.

24. The image forming apparatus according to claim 22, wherein in a case in which the normal set value of the transfer bias is supplied as a first transfer bias starts to be supplied, the predetermined time period is from a time at which the first transfer bias starts to be supplied to a time at which a transfer bias potential reaches a peak of overshoot.

25. An image forming apparatus comprising:

a photosensitive member to bear an electrostatic latent image on a surface thereof;

a charging device to charge the surface of the photosensitive member;

an exposure device to illuminate a charged surface of the photosensitive member to form an electrostatic latent image on the surface of the photosensitive member;

a developing device to develop the electrostatic latent image using toner to form a toner image;

a transfer device to transfer the toner image from the photosensitive member to a transfer medium at a transfer position;

a charging bias output device to supply a charging bias to the charging device;

a developing bias output device to supply a developing bias to the developing device;

a transfer bias output device to supply a transfer bias to the transfer device; and a controller operatively connected to the charging bias output device, the developing bias output device, and the transfer bias output device to control the charging bias output device, the developing bias output device, and the transfer bias output device, the controller controlling the transfer bias output device to supply the transfer bias from a time at which a first position of the photosensitive member arrives at the transfer position after the charging bias output device starts supplying the charging bias, an initial value of the transfer bias being controlled to be a constant value smaller than a normal set value for a predetermined time period which is a time after the transfer bias starts to be supplied and within a time corresponding to a rise time during which a surface potential of the photosensitive member reaches a predetermined potential after the charging bias starts to be output, wherein the first position of the photosensitive member is a position at which the charging device starts charging the photosensitive member.

* * * * *